US009739081B2

(12) United States Patent
Stuke

(10) Patent No.: US 9,739,081 B2
(45) Date of Patent: Aug. 22, 2017

(54) MULTI-LINK HINGE WITH DAMPING

(71) Applicant: HETTICH-ONI GMBH & CO. KG, Vlotho (DE)

(72) Inventor: Kai Michael Stuke, Bielefeld (DE)

(73) Assignee: Hettich-Oni GMBH & Co. KG, Vlotho (DE)

( * ) Notice: Subject to any disclaimer, the term of this patent is extended or adjusted under 35 U.S.C. 154(b) by 113 days.

(21) Appl. No.: 14/764,417

(22) PCT Filed: Jan. 31, 2014

(86) PCT No.: PCT/EP2014/051899
§ 371 (c)(1),
(2) Date: Jul. 29, 2015

(87) PCT Pub. No.: WO2014/118320
PCT Pub. Date: Aug. 7, 2014

(65) Prior Publication Data

US 2015/0361709 A1 Dec. 17, 2015

(30) Foreign Application Priority Data

Feb. 1, 2013 (DE) ..... 10 2013 101 040

(51) Int. Cl.
*E05F 5/10* (2006.01)
*E05D 3/16* (2006.01)
(Continued)

(52) U.S. Cl.
CPC ..... *E05F 5/10* (2013.01); *E05D 3/06* (2013.01); *E05D 3/16* (2013.01); *E05F 5/006* (2013.01);
(Continued)

(58) Field of Classification Search
CPC .... E05F 5/10; E05F 5/006; E05F 1/14; E05D 3/06; E05D 3/16; Y10T 16/5409
See application file for complete search history.

(56) References Cited

U.S. PATENT DOCUMENTS 4,449,269 A * 5/1984 Sundermeier ..... E05D 3/142 16/302
4,590,641 A * 5/1986 Lautenschlager ..... E05D 3/16 16/238
(Continued)

FOREIGN PATENT DOCUMENTS

DE 102005021540 11/2006
DE 202006013358 U1 2/2008
(Continued)

OTHER PUBLICATIONS

Search Report issued in Int'l App. No. PCT/EP2014/051899 (2014).
Search Report issued in German App. No. 10 2013 101 040.7 (2013).

*Primary Examiner* — Jeffrey O Brien
(74) *Attorney, Agent, or Firm* — Barnes & Thornburg LLP

(57) ABSTRACT

The invention relates to a multi-link hinge for furniture, with a fastening element which can be secured indirectly or directly to a furniture body and is connected to a pivotable door bearing via a plurality of link levers connected to one another in a scissors-like manner, wherein a linear damper which damps both a closing movement and an opening movement of the door bearing is provided. The multi-link hinge is distinguished in that the linear damper is ineffective in a central portion of the pivoting range of the door bearing.

17 Claims, 5 Drawing Sheets

Figure 1:
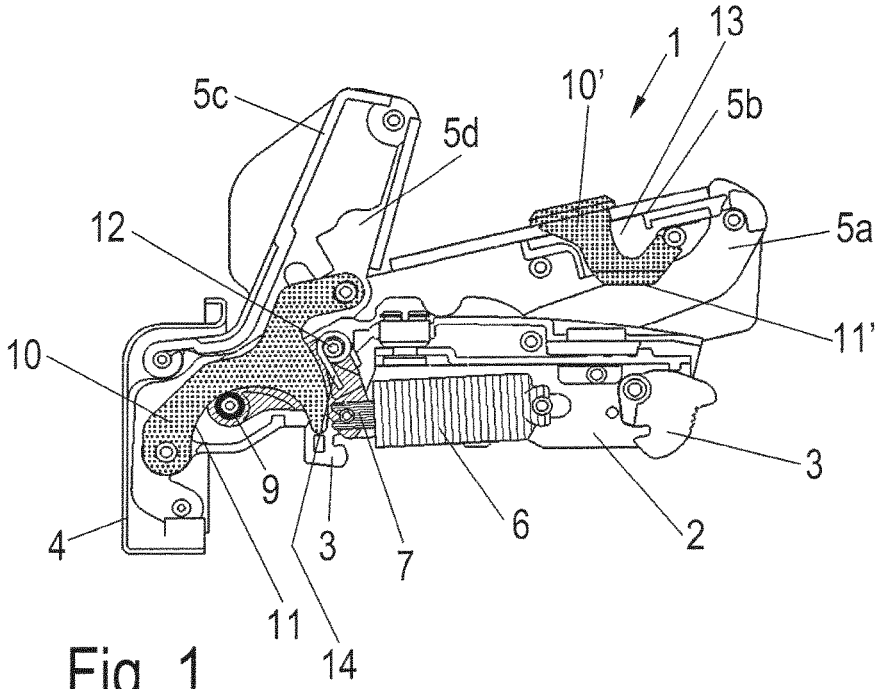

(51) Int. Cl.
*E05F 5/00* (2017.01)
*E05D 3/06* (2006.01)
*E05F 1/14* (2006.01)

(52) U.S. Cl.
CPC ..... *E05F 1/14* (2013.01); *E05Y 2201/412* (2013.01); *E05Y 2201/424* (2013.01); *E05Y 2800/73* (2013.01); *E05Y 2900/20* (2013.01); *Y10T 16/5409* (2015.01)

(56) References Cited

U.S. PATENT DOCUMENTS 5,269,043 A * 12/1993 Yang ..... E05F 5/006 16/68
7,096,535 B2 * 8/2006 Lin ..... E05D 11/1021 16/286
7,275,284 B2 * 10/2007 Lautenschlager ..... E05D 3/142 16/287
7,406,749 B2 * 8/2008 Herper ..... E05F 5/006 16/286
7,478,891 B2 * 1/2009 Hollenstein ..... E05F 1/1058 312/319.2
7,500,287 B2 * 3/2009 Brustle ..... E05F 1/1075 16/286
7,591,046 B2 * 9/2009 Zetti ..... E05D 3/16 16/286
7,861,376 B2 * 1/2011 Fitz ..... E05D 3/16 16/286
8,205,298 B2 * 6/2012 Lin ..... E05F 5/006 16/245
8,307,498 B2 * 11/2012 Krammer ..... E05F 5/006 16/50
8,561,259 B2 * 10/2013 Liao ..... E05D 3/142 16/286
8,572,811 B2 * 11/2013 Lautenschlager ..... E05D 3/14 16/286
8,601,644 B1 * 12/2013 Chen ..... E05F 5/006 16/286
8,656,559 B2 * 2/2014 Hung ..... E05D 3/16 16/286
8,713,760 B2 * 5/2014 Krudener ..... E05D 3/16 16/370
8,863,356 B2 * 10/2014 Bacchetti ..... E05F 3/104 16/252
8,959,709 B2 * 2/2015 Hasegawa ..... E05D 3/14 16/50
9,169,681 B2 * 10/2015 Cooper ..... E05D 3/14
9,528,307 B2 * 12/2016 Rohner ..... E05D 3/12
2007/0220705 A1 * 9/2007 Fitz ..... E05F 5/006 16/54
2007/0251058 A1 * 11/2007 Fitz ..... E05D 3/16 16/287
2008/0172834 A1 * 7/2008 Sutterlutti ..... E05D 3/142 16/286
2012/0085036 A1 * 4/2012 Nishida ..... E05F 5/10 49/386
2012/0118842 A1 * 5/2012 Salice ..... E05D 3/14 211/144
2013/0019713 A1 * 1/2013 Krudener ..... E05D 3/16 74/99 R
2014/0345082 A1 * 11/2014 Collene ..... E05F 1/1058 16/58
2015/0218863 A1 * 8/2015 Cooper ..... E05D 3/14 16/235
2015/0330128 A1 * 11/2015 Ng ..... E05D 3/16 16/65
2016/0040466 A1 * 2/2016 Cooper ..... E05D 3/14 16/50

FOREIGN PATENT DOCUMENTS

DE 202007004621 U1 8/2008
DE 202009004837 U1 10/2010
DE 102010006816 8/2011
EP 2093361 8/2009
WO WO 2004/083580 9/2004
WO WO 2009/060723 5/2009

* cited by examiner

Fig. 7
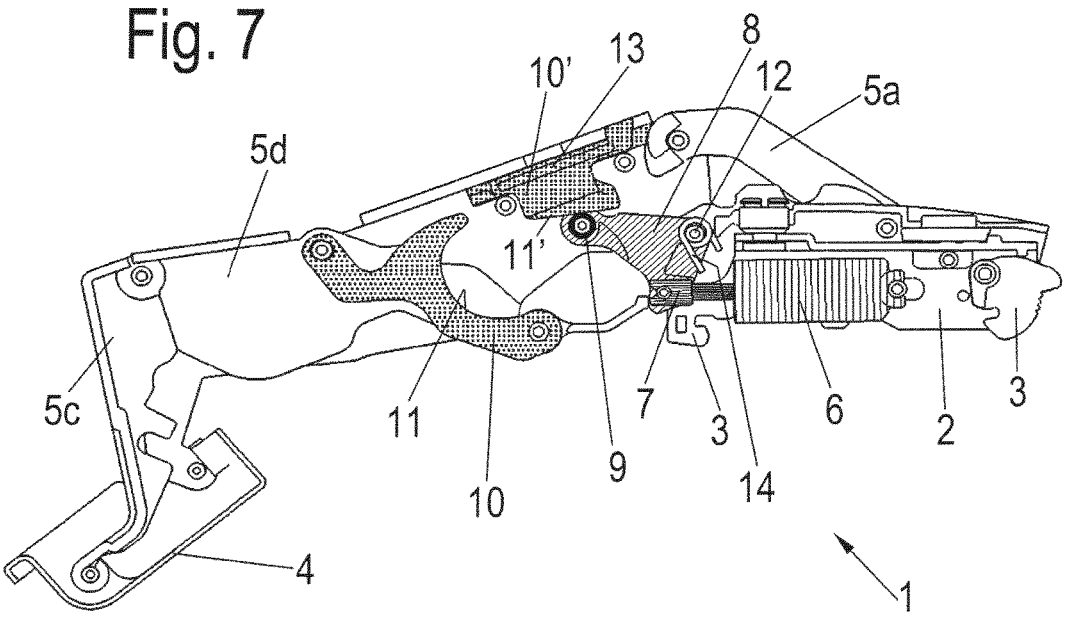
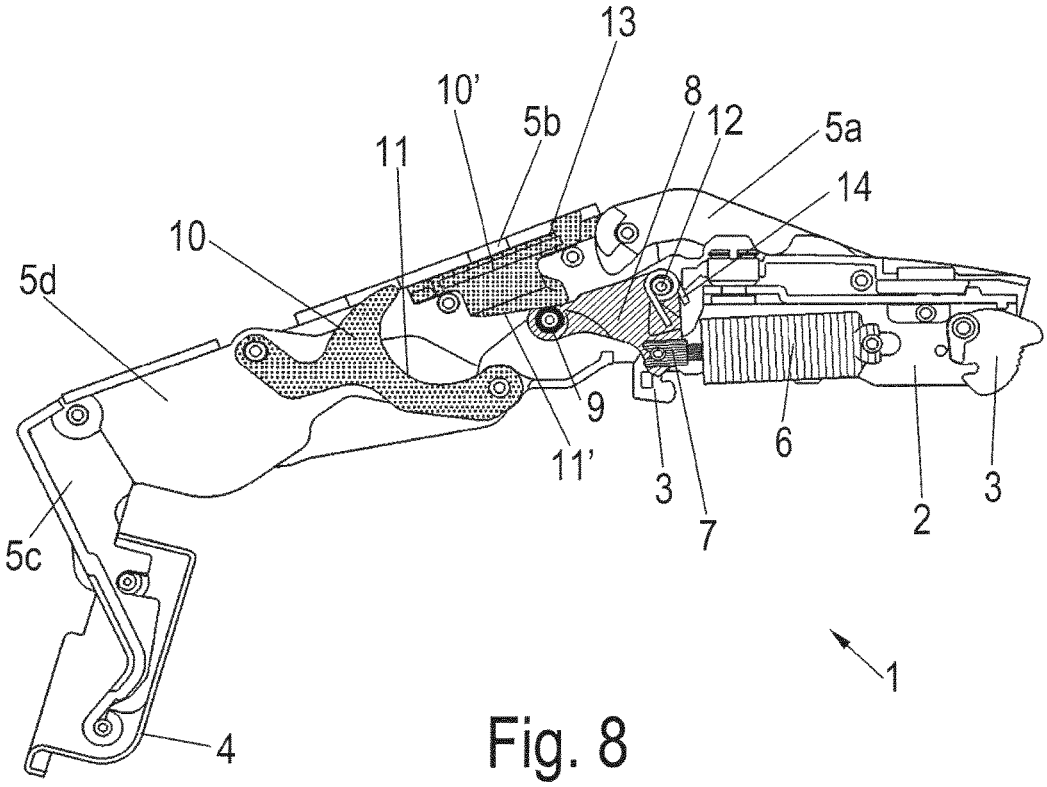
Fig. 8

MULTI-LINK HINGE WITH DAMPING

This application is a U.S. nationalization under 35 U.S.C. §371 of International Application No. PCT/EP2014/051899, filed Jan. 31, 2014, which claims priority to German Patent Application No. 102013101040.7, filed Feb. 1, 2013. The disclosures set forth in the referenced applications are incorporated herein by reference in their entireties.

The disclosure relates to a multi-link hinge for a piece of furniture, comprising a fastening element which can be secured indirectly or directly to a furniture body and which is connected to a pivotable door bearing via a plurality of link levers that are connected to one another in a scissors-like manner. A linear damper may be provided which dampens both a closing movement and an opening movement of the door bearing.

Multi-link hinges are often used for furniture doors, especially for kitchen furniture doors. The arrangement of the hinge as a multi-link hinge allows a combined rotational and pivoting movement, e.g., in order open a door from a closed front of several doors that are arranged adjacent to each other and especially in order to enable the opening of said doors by more than 90° without striking adjacent doors. Such a multi-link hinge is frequently provided with a spring in order to pretension the hinge in a closed position and to thus support secure and flush closing of the door.

In using such a multi-link hinge, however, a door arranged on the fastening part can be slammed in an uncontrolled manner, even if supported by the spring.

In order to prevent this effect, a multi-link hinge with an integrated linear damper is known from the specification DE 20 2007 004 621 U1, by means of which a closing movement of the multi-link hinge is dampened.

When a furniture door linked via a multi-link hinge is opened up to the maximum opening angle, the door or the components within the hinge, e.g., the link lever, may strike a limit stop in an unbraked manner. This can lead to strong loading of the material, which may cause destruction of the hinge or the connection between the multi-link hinge and the furniture body or the furniture door.

In order to prevent this, a multi-link hinge is known from the specification EP 2 093 361 A2, in which a linear damper or also a rotational damper dampens both the closing and also the opening movement. The damper interacts with at least one of the link levers. Said interaction is arranged in such a way that the damper is actuated effectively from a specific opening angle which lies in the range of half the opening angle, both during a closing and also an opening movement. The damping apparatus thus finally acts over the entire opening angle, which can lead to an unusual actuating perception during the movement of the door in a middle opening angle range.

The present disclosure illustrates and describes a multi-link hinge of the kind mentioned above which dampens both an opening and closing movement with a linear damper, wherein a movement of a door linked by the multi-link hinge can occur as freely as possible in a middle opening angle range.

A multi-link hinge of the kind mentioned above in accordance with the disclosure is characterized in that the linear damper is ineffective in a central portion of the pivoting range of the door bearing. A portion of the pivoting range beneath a first opening angle of the hinge is provided in which the linear damper dampens a closing movement and a portion of the pivoting range above a second opening angle in which the linear damper dampens an opening movement. A central portion in which the linear damper is ineffective and the mounted furniture door can move freely is situated in accordance with the invention between the two portions in which the linear damper is effective. As a result, the furniture door can be moved smoothly in said central portion of the pivoting range, as is also expected intuitively by the user.

In an embodiment of the multi-link hinge, the linear damper is actuated directly or indirectly by at least one of the link levers, wherein the at least one link lever is in engagement with the linear damper only outside of the central non-dampened portion of the pivoting range. Indirect actuation can occur via lever kinematics. The actuation of the linear damper by the link lever ensures that the damping mechanism can be integrated very well in the hinge. The coupling of the link lever only outside of the central portion leads to free mobility of the furniture door.

The at least one link lever actuating the linear damper may comprise at least one driver for the actuation of the linear damper. The driver can be integrally formed on the link lever, which allows simple design. The driver can be formed alternatively on an actuating element which is fixed to the link lever. The driver may be releasably fixed to the link lever, as a result of which the desired damping function can be retrofitted or an undesirable damping function can also be removed again by the user.

Two actuating elements may be provided, which are fixed to two different link levers, wherein a first one of the actuating elements directly or indirectly actuates the linear damper during the closing movement and the second one of the actuating elements actuates the linear damper directly or indirectly during the opening movement. As a result, the different damping functions (during closing and opening) can be influenced individually through the configuration of the drivers. An influence on the characteristics of the damping can occur in such a way that the driver is arranged as a control cam.

In further embodiments of the multi-link hinge, it may comprise at least one first energy storage unit which pretensions the multi-link hinge in a closed position and/or a second energy storage unit which moves the linear damper back to its initial position. The first energy storage unit ensures complete closure of the furniture door. The second energy storage unit ensures that the linear damper assumes its initial position after relief and is ready for a further damping process. If the first and the second energy storage unit are present, the second energy storage unit generates a lower force component in the opening direction than the first energy storage unit in the closing direction, in order to thus ensure that the function of the first energy storage unit is not compromised by the presence of the second energy storage unit.

In further embodiments of the multi-link hinge, the damping of the closing movement is effective at an opening angle of less than 50° and/or the damping of the opening movement is effective at an opening angle which at most is 35° lower than the maximum opening angle of the multi-link hinge. In a further aspect, the central portion of the pivoting range extends over an angular range of at least 30° and preferably at least 60°. In these embodiments, the non-dampened central portion of the pivoting range is large enough in any case so that an expected movement behaviour of the furniture door is produced during opening and closing.

In a further embodiment of the multi-link hinge, it comprises seven shafts on which the link levers are connected to each other, i.e. a seven-shaft hinge is thus formed.

FIGS. 1 to 4 show a multi-link hinge in a first embodiment in different opening positions, and FIGS. 5 to 8 show a multi-link hinge in a second embodiment in different opening positions.

The following described illustrations of FIGS. 1 to 8 show two embodiments of a multi-link hinge in accordance with the disclosure, each in a schematic sectional view. In all illustrations, the same reference numerals relate to similar or similarly acting elements.

FIGS. 1 to 4 show a first embodiment of a multi-link hinge, which will be referred to below for reasons of simplicity as hinge 1. In FIG. 1, the hinge 1 is shown in a closed position, in FIG. 2 in a central opening position with an opening angle of approximately 90°, in FIG. 3 with an opening angle of approximately 130°, and in FIG. 4 with a maximum opening angle of 165°.

The hinge 1 comprises a fastening element 2 which can be fixed to a furniture body. Latching means 3 are provided for this purpose on the fastening element 2, which can be latched onto a fastening plate which is not shown here and which can be fixed by means of screws to the furniture body. The hinge 1 further comprises a door bearing 4 which is connectable to a furniture door. The door bearing 4 is conventionally arranged as a pot bearing. Alternative embodiments are possible, e.g. for screwing onto the furniture door.

The door bearing 4 is connected to the fastening element 2 via a plurality of different link levers 5*a* to 5*f*, such that it performs relative to said fastening element a combined rotational and pivoting movement upon actuation of the hinge 1. The fastening element 2 is arranged in an approximately U-shaped manner and is open in the direction of the fastening plate (not shown).

A linear damper 6 is arranged in the enclosed region, in which a damper rod 7 travels into a cylinder. The cylinder is pivotably connected at its end facing away from the damper rod 7 to the fastening element 2. The damper rod 7 is subjected to damping when travelling into the cylinder of the linear damper 6.

A lever kinematic system 8 is further arranged on the fastening element 2, which kinematic system may simply comprise a shaft and a lever limb. In the present case, a lever kinematic system 8 is used in form of a substantially L-shaped deflection lever. A lever kinematic system 8 with several levers and shafts can be necessary depending on the used damper (traction or pressure damper) or hinge configuration in order to temporarily produce the coupling between the damper movement and the link lever movement.

The damper rod 7 is connected at its end to a limb of the deflection lever. The deflection lever is also pivotably mounted on the fastening element 2, wherein a second energy storage unit 14 (a leg spring in this case) is provided, which acts on the deflection lever in such a way that the damper rod 7 travels out of the cylinder of the linear damper 6 when the second free limb of the deflection lever is not subjected to a force.

A roller 9 or alternatively a protruding cross bolt is attached to the free limb of the deflection lever. If said deflection lever is moved at its free end on the roller 9 or the cross bolt in the direction of the fastening plate (downwardly in the drawings), the damper rod 7 travels into the cylinder of the linear damper 6.

In order to produce a damping effect during the closing of the furniture door, a first actuating element 10 is attached to one of the link levers (5*a* to 5*d*), and in this case the link lever 5*d*, which comprises a driver 11 which comes into engagement with the roller 9 of the deflection lever beneath a specific opening angle of the hinge 1. In an embodiment, which is also implemented in the illustrated embodiment, the driver 11 is formed as a control cam. Both the starting point of the closing damping and also its force progression can be determined by the shape of the control cam. The starting point of the closing damping describes the opening angle of the hinge from which a rotational movement of the flexible lever and consequently a movement of the damper rod 7 and thus an effective damping commences during a closing movement. The roller 9 is not in contact with the control cam above said opening angle, as can be seen, for example, in the open position of approximately 90° in FIG. 2. In alternative embodiments of the hinge 1, the driver 11 can also consist of a coupling mechanism which temporarily connects to the lever kinematic system 8 in the opening and closing range to be dampened.

When the furniture door is opened beyond said starting point of the closing damping, it can subsequently be moved in a respectively free manner in a central portion of the pivoting range. Said central portion extends over a few tens of degrees, and more than 60° in the present case.

Figure 3:
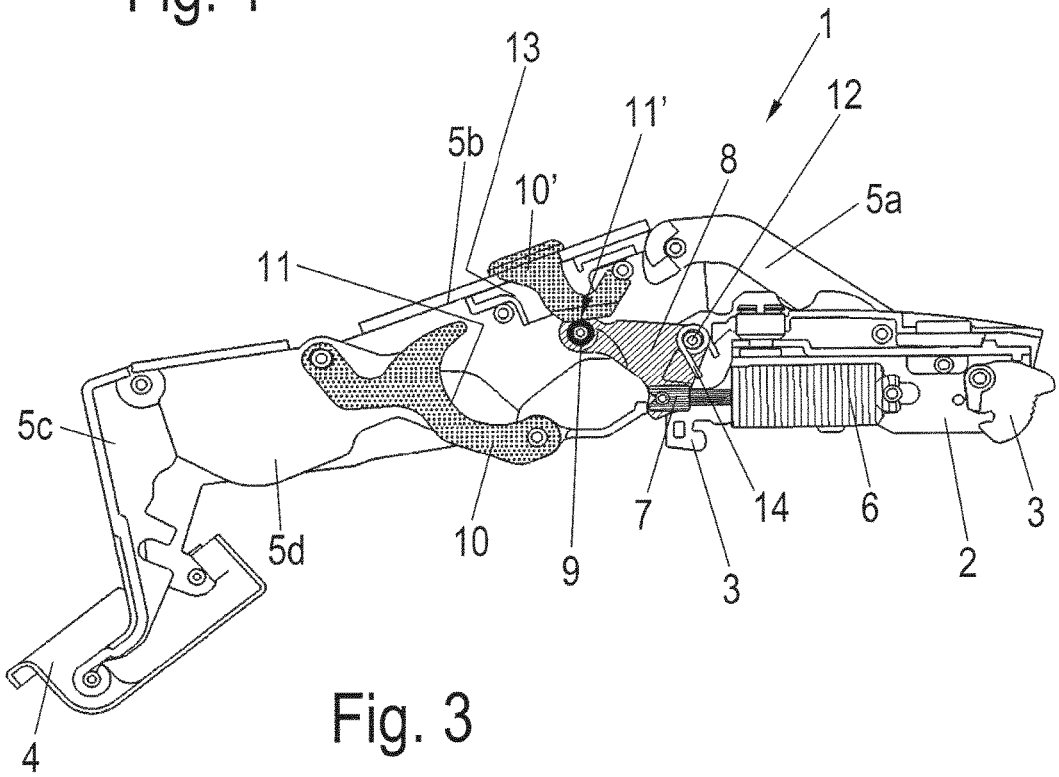
Figure 2:
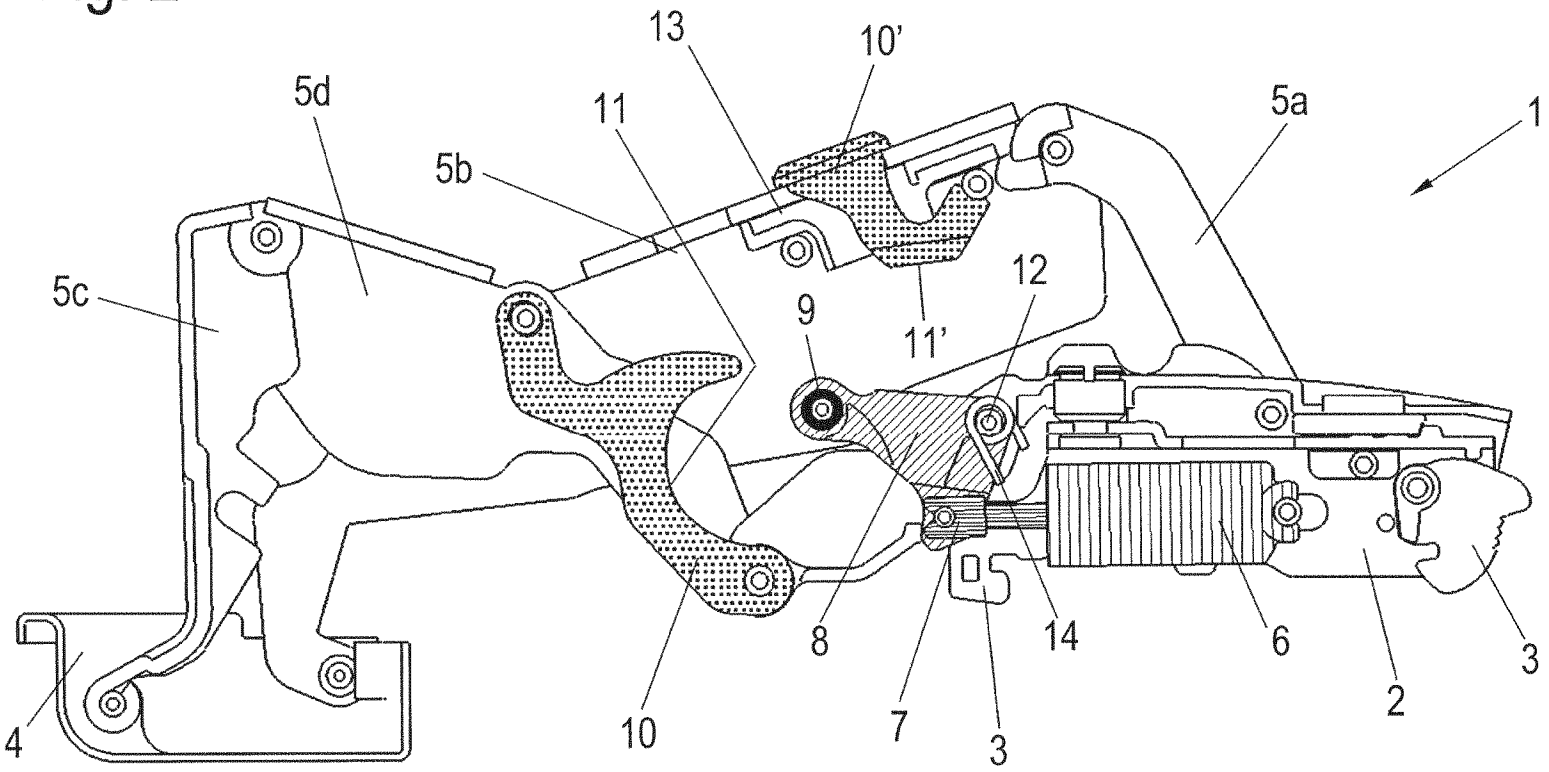

During further opening of the furniture door, opening damping commences at an opening angle which in the illustrated case lies approximately 35° before the maximum opening position. FIG. 3 shows the hinge 1 at an opening angle at which the opening damping has just started.

Figure 4:
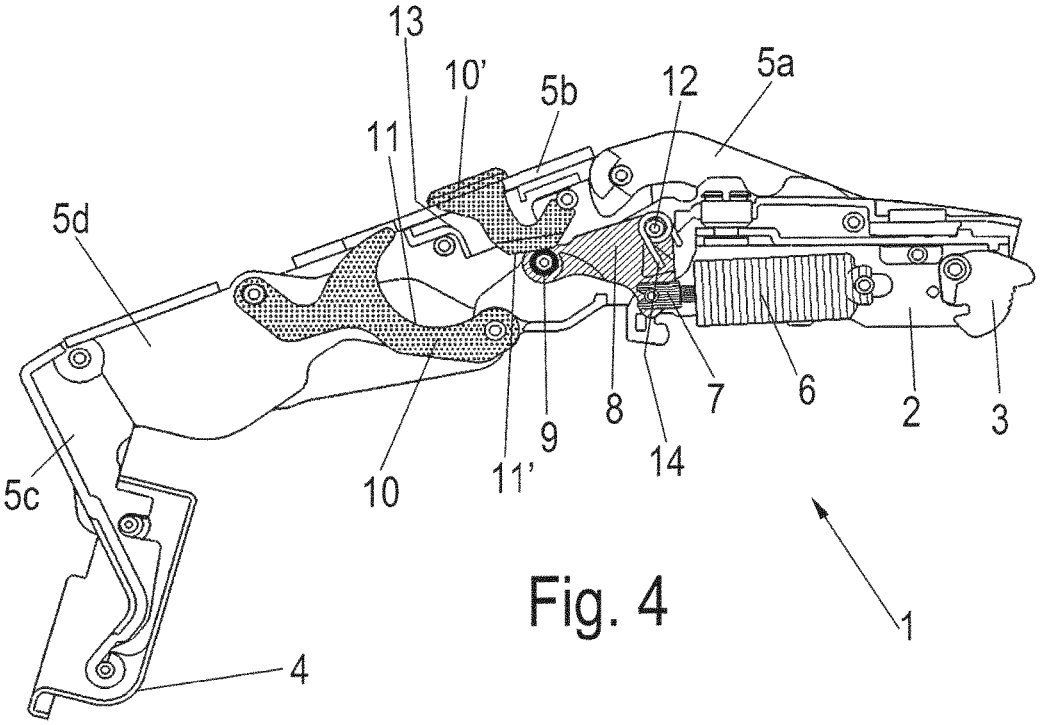
Figure 5:
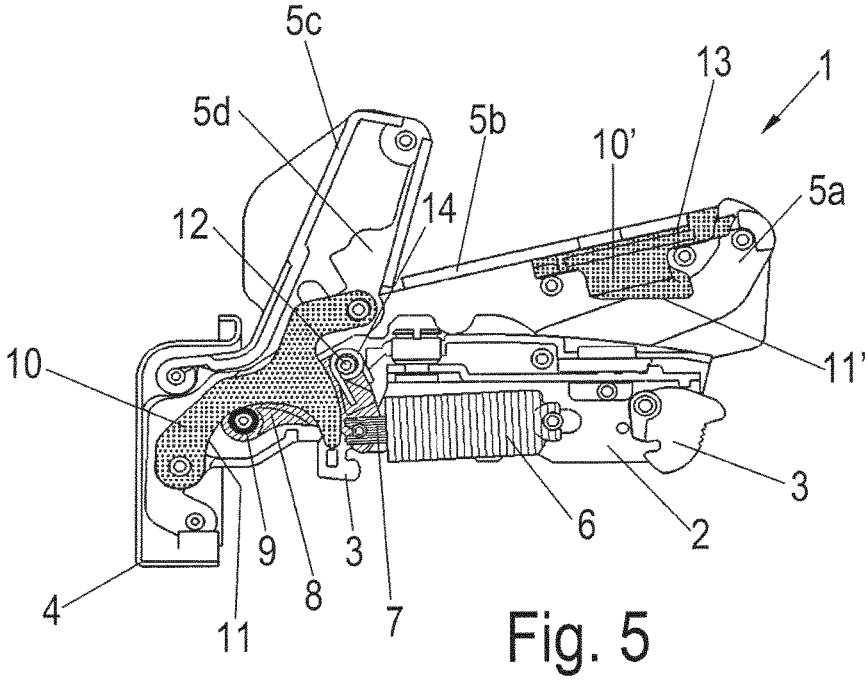
Figure 6:
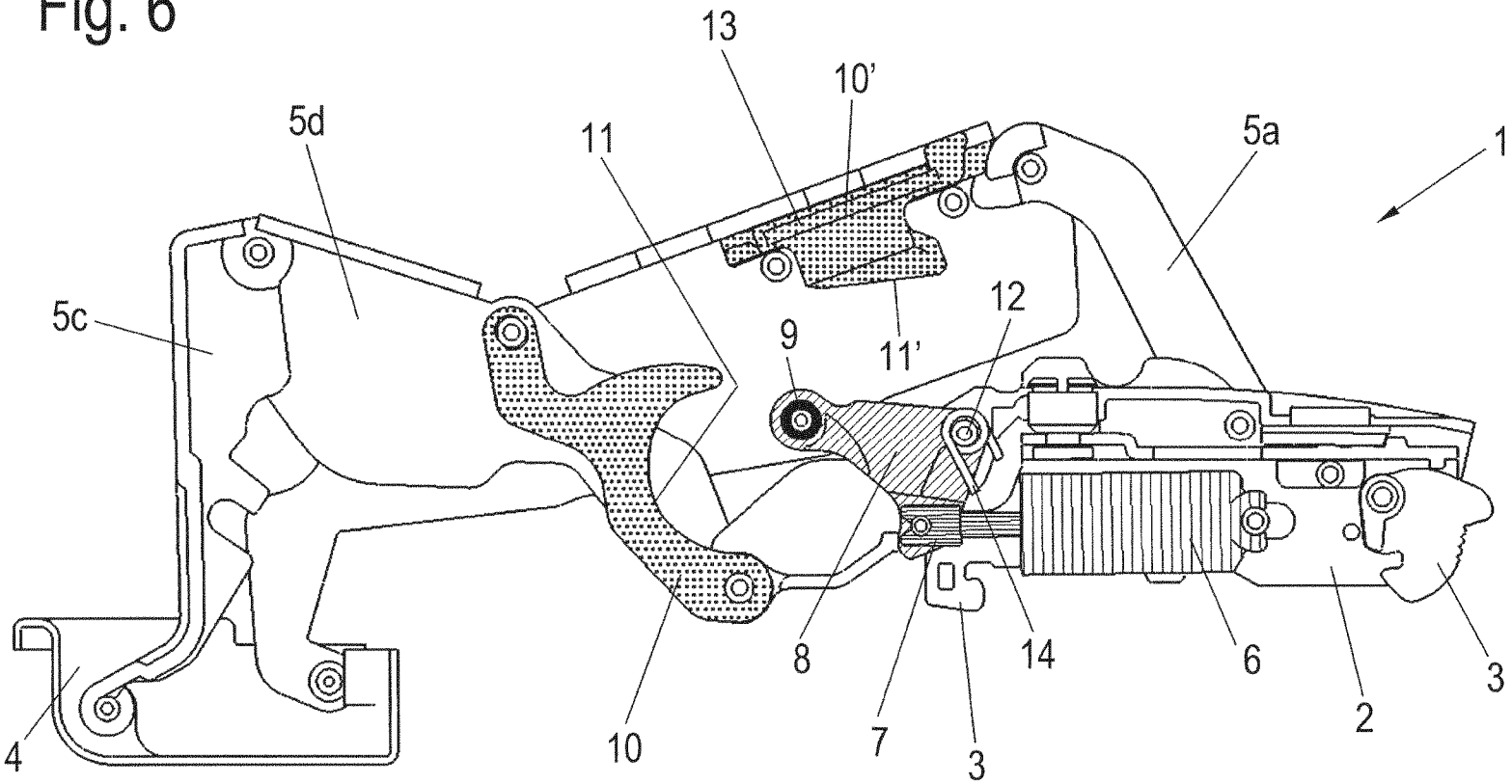

The opening damping is also realised by means of the linear damper 6. A second actuating element 10' is provided for this purpose, which in the present case is fixed to the link lever 5*b*. Said second actuating element 10' comprises a driver 11', which is also arranged in this case as a control cam which comes into contact with the roller 9 at the starting angle for the opening damping and moves said roller—as in the case of damping for the closing movement—in the direction of the fastening plate of the hinge 1 (downwardly in the drawings), through which the damper rod 7 is moved into the cylinder of the linear damper 6. In the illustrated case, the further control cam is substantially straight. As a result of the interaction of the second actuating element 10' with the deflection lever, damping is achieved up to the maximum opening position of approximately 165° in this case, as shown in FIG. 4.

The actuating elements 10 and 10' for the closing and opening damping may be arranged on different link levers 5*a* to 5*f*. In the case of suitable kinematics of a link lever, it is also possible to arrange both actuating elements 10 and 10' on this one link lever.

FIGS. 5 to 8 show an alternative embodiment of the multi-link hinge 1 represented in FIGS. 1 to 4. The multi-link hinge 1 shown in these drawings does not differ with respect to its basic configuration from the one shown in FIGS. 1 to 4.

The hinge 1 is again shown in different opening positions. The hinge 1 is shown in a closed position in FIG. 5, and in FIG. 6 in a central opening position with an opening angle of approximately 90° in which the roler 9 is not in contact with any of the control cams 11 and 11'. FIG. 7 shows the hinge 1 at an opening angle of approximately 130°, and FIG. 8 at a maximum opening angle of 165°.

In contrast to the embodiment of FIGS. 1 to 4, the shaping of the further actuating element 10' differs in this case, via which the linear damper 6 is actuated during the opening of the multi-link hinge 1. The further actuating element 10' is formed in both cases in such a way that it can be retrofitted in a simple way and preferably without tools. The second actuating element 10' is an integral shaped part made of plastic for example, which can be clipped in a snap-on fashion onto or into the respective link lever 5*b*. Openings in the link levers or also the inserted rotational shafts can be used for fixing.

It is also possible in alternative embodiments to rigidly connect the actuating element 10 and/or 10' to the respective link levers 5*a* to 5*d*. It is also possible to use the link levers 5*a* to 5*d* as actuating elements 10 and/or 10' themselves, in that one of their surfaces or edges of the driver 11 or 11' is arranged as a control cam.

The invention claimed is:

1. A multi-link hinge for a piece of furniture, comprising:

a fastening element configured to be secured indirectly or directly to a furniture body and which is connected to a pivotable door bearing via a plurality of link levers that are connected to one another in a scissors configuration, an L-shaped lever pivotable about a shaft on the fastening element;

a first one of the plurality of link levers comprising a first driver;

a second one of the plurality of link levers comprising a second driver; and a linear damper connected to the L-shaped lever;

wherein during a closing movement, the first driver engages the L-shaped lever which actuates the linear damper for dampening the closing movement, wherein during an opening movement, the second driver engages the L-shaped lever which actuates the linear damper for dampening the opening movement, and wherein the linear damper is ineffective in a central portion of the pivoting range of the door bearing.

2. A multi-link hinge according to claim 1, wherein the first driver and the second driver are in engagement with the L-shaped lever only outside of the central non-dampened portion of the pivoting range.

3. A multi-link hinge according to claim 1, wherein at least one of the first and second drivers is formed integrally on the respective one of the first and second link lever.

4. A multi-link hinge according to claim 1, wherein at least one of the first and second drivers is arranged as a control cam.

5. A multi-link hinge according to claim 1, comprising at least one first energy storage unit which pretensions the multi-link hinge in a closed position.

6. A multi-link hinge according to claim 1, comprising at least one second energy storage unit which moves the linear damper back to its initial position.

7. A multi-link hinge according to claim 1, wherein the damping of the closing movement is effective at an opening angle of less than 50°.

8. A multi-link hinge according to claim 1, wherein the damping of the opening movement is effective at an opening angle which is at most 35° less than a maximum opening angle of the multi-link hinge.

9. A multi-link hinge according to claim 1, wherein the central portion of the pivoting range extends over an angular range of at least 30°.

10. A multi-link hinge according to claim 1, comprising seven shafts, on which the plurality of link levers are connected to each other.

11. A multi-link hinge according to claim 1, wherein the central portion of the pivoting range extends over an angular range of at least 60°.

12. A multi-link hinge according to claim 1, wherein the first driver is formed on a separate first actuating element which is fixed to the first one of the plurality of link levers.

13. A multi-link hinge according to claim 1, wherein the second driver is formed on a separate second actuating element which is fixed to the second one of the plurality of link levers.

14. A multi-link hinge according to claim 12, wherein the second driver is formed on a separate second actuating element which is fixed to the second one of the plurality of link levers.

15. A multi-link hinge according to claim 1, wherein the first driver is formed on a separate first actuating element which is releasably fixed to the first one of the plurality of link levers.

16. A multi-link hinge according to claim 1, wherein the second driver is formed on a separate second actuating element which is releasably fixed to the second one of the plurality of link levers.

17. A multi-link hinge according to claim 15, wherein the second driver is formed on a separate second actuating element which is releasably fixed to the second one of the plurality of link levers.

* * * * *